United States Patent [19]

Tajima et al.

[11] Patent Number: 4,650,270

[45] Date of Patent: Mar. 17, 1987

[54] SHIELDING CONNECTOR

[75] Inventors: Kyousuke Tajima; Satoru Kanuma, both of Gunma, Japan

[73] Assignee: Hosiden Electronics Co., Ltd., Osaka, Japan

[21] Appl. No.: 826,465

[22] Filed: Feb. 5, 1986

[30] Foreign Application Priority Data

May 13, 1985 [JP] Japan ..... 60-70222[U]

[51] Int. Cl.[4] ..... H01R 13/658

[52] U.S. Cl. ..... 339/143 R; 339/155 R; 339/205

[58] Field of Search ..... 339/143 R, 14 R, 14 P, 339/154 R, 154 A, 155 R, 156 R, 164 R, 164 M, 205, 184 R, 184 M, 186 R, 186 M

[56] References Cited

U.S. PATENT DOCUMENTS 3,772,633 11/1973 Danesi ..... 339/154 R
4,398,780 8/1983 Novotny et al. ..... 339/143 R
4,568,133 2/1986 Amano et al. ..... 339/143 R

FOREIGN PATENT DOCUMENTS 2840513 4/1979 Fed. Rep. of Germany ..... 339/205

*Primary Examiner*—John McQuade
*Attorney, Agent, or Firm*—Pollock, Vande Sande and Priddy

[57] ABSTRACT

A tubular insulating cover, open at its both ends, has disposed therein a cylindrical shielding conductor coaxially therewith. First and second connector sockets are fitted into the cylindrical shielding conductor from its both ends, in which corresponding contacts of the first and second connector sockets are interconnected. The outer end faces of the first and second connector sockets each has cut therein an annular groove for receiving a cylindrical metal cover of a mating plug. An annular contact for engagement with the cylindrical metal cover of the plug is received in each of the annular grooves and terminals of the annular contacts are connected to the cylindrical shielding conductor.

14 Claims, 8 Drawing Figures

SHIELDING CONNECTOR

BACKGROUND OF THE INVENTION

The present invention relates to a shielding connector which is employed for interconnecting, for example, personal computers.

Recently it has become quite usual with government offices and private corporations to build up a telecommunication network in which various equipments such as personal computers or word processors are interconnected for direct data transmission and reception therebetween.

In the case of interconnecting personal computers or the like, shielded cables are usually employed for the purpose of preventing the effects of external noise. Conventionally, a shielded cable of a length corresponding to the distance between the units to be interconnected is prepared and plugs are attached to both ends of the cable and then the plugs are inserted into sockets of the units, establishing electrical connection therebetween.

The conventional method involves the troublesome work of preparing a shielded cable of a length corresponding to the distance between the units to be interconnected and connecting plugs to the both ends of the cable. These tasks may be easy for those engaged in electric work but are difficult for unskilled persons.

It would be very convenient if such units could be interconnected by simply connecting together a required number of extension cables each of which has been provided with plugs at its opposite ends and has a predetermined length. In the past, however, since there has not been available any means for interconnecting such extension cables in a plug-socket relation, all connecting tasks have been entrusted to skilled persons.

SUMMARY OF THE INVENTION

It is therefore an object to provide a shielding connector which permits the interconnection of a required number of shielded extension cables, each having plugs connected to its opposite ends.

Another object of the present invention is to provide a shielding connector which is very easy to manufacture.

According to the present invention, a tubular insulating cover, which is open at both ends, has held therein a cylindrical shielding conductor coaxially therewith, and the shielding conductor has disposed therein an insulating body. Both end faces of the insulating body are held in opposing relation to both of the open end faces of the cover, respectively. The insulating body has first and second annular grooves cut in its two end faces and pluralities of first and second contact receiving holes made in first and second columnar portions on both end faces encompassed by the first and second annular grooves. First and second annular contacts for engagement with cylindrical metal covers of plugs are respectively received in the first and second annular grooves coaxially therewith. Terminals of the first and second annular contacts are electrically connected to the cylindrical shielding conductor. First and second female contacts for contact with contact pins of the plugs are respectively received in the first and second contact receiving holes, wherein the corresponding first and second female contacts are interconnected.

By adopting a connector structure in which the insulating body is formed by first and second insulating blocks and the first and second annular contacts and the first and second female contacts are mounted in the two blocks, respectively, it is possible to use individual first and second connector sockets. The cylindrical shielding conductor is formed, for instance, by assembling two semicylindrical members, each of which has notches cut in its marginal edges so that they form holes when the semicylindrical members are assembled. The terminals of the first and second annular contacts are led out of the shielding conductor through the holes and soldered to the outer periphery of the shielding conductor. The insulating cover can be formed integrally with the assembly of the shielding conductor and the first and second connector sockets by molding a resin material. The outer end faces of the first and second connector sockets are positioned inside the open end faces of the insulating cover, forming recesses therein.

With the use of the shielding connector of the present invention, it is possible to freely connect together a required number of extension cables each having plugs attached to its both ends.

Moreover, since the shielding conductor is mounted around the insulating body, a signal line in the connector portion is also shielded from the effects of external noise.

DESCRIPTION OF THE PREFERRED EMBODIMENTS

Figure 1:
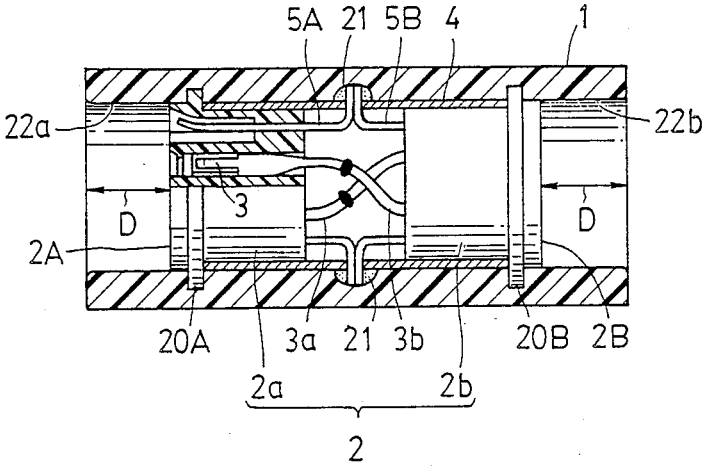
FIG. 1 is a sectional view illustrating an embodiment of the present invention.
Figure 2:
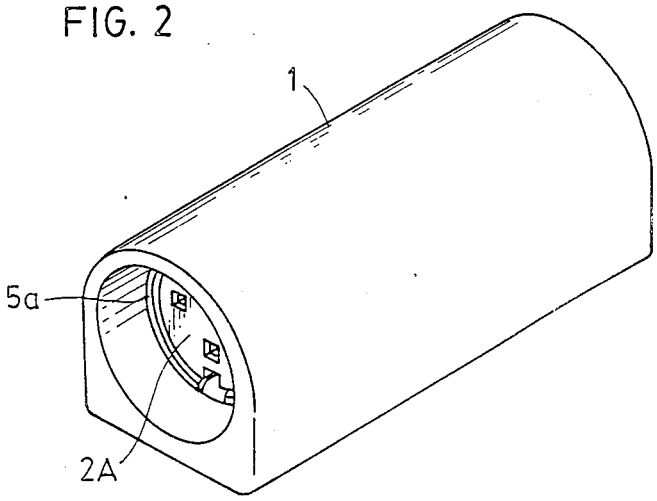
FIG. 2 is a perspective view showing the external appearance of the embodiment depicted in FIG. 1.

FIG. 1 illustrates in cross-section the structure of an example of the shielding connector of the present invention and FIG. 2 shows in perspective its external appearance. A hollow, tubular insulating cover 1 both ends of which are open has an insulating body 2 mounted therein. In this example the insulating body 2 is shown to be comprised of a pair of insulating blocks **2*a* and 2*b* which are aligned in the axial direction of the tubular insulating cover 1. The insulating blocks 2*a* and 2*b* respectively hold pluralities of female contacts 3 and their terminals 3*a* and 3*b*** of the same pin numbers are interconnected.

This example utilizes existing connector sockets, which are almost identical in construction, except for its terminals, with a connector socket proposed, for instance, in Tajema U.S. patent application Ser. No.

791,869, assigned to the assignee of the present application. The shielding connector of the present invention is characterized by the insulating body 2 which has means for engagement with plugs at opposite ends of the tubular insulating cover 1, a cylindrical shielding conductor 4 which is mounted around the insulating body 2, and annular contacts 5*a* and 5*b* which are secured to the opposite ends of the insulating body 2 and electrically connected to the cylindrical shielding conductor 4. The annular contacts 5*a*, 5*b* each have terminals 5A, 5B which are received in holes made in the cylindrical shielding conductor 4 and soldered thereto on the outside thereof, as indicated by 21, thus providing electrical connections between the cylindrical shielding conductor 4 and the annular contacts 5*a* and 5*b*.

Figure 3:
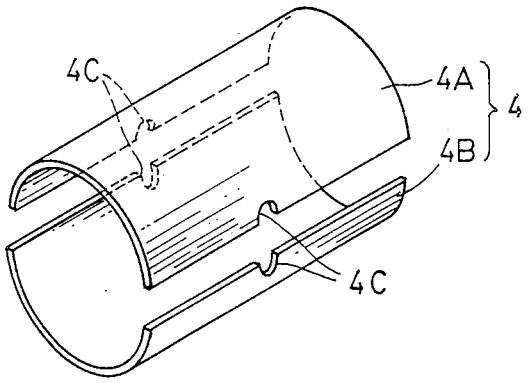
FIG. 3 is a schematic diagram showing the structure of a cylindrical shielding conductor for use in the embodiment depicted in FIG. 1.

The cylindrical shielding conductor 4 in this example is comprised of a pair of semicylindrical members 4A and 4B which are assembled into a cylindrical shape, as depicted in FIG. 3. The semicylindrical members 4A and 4B have notches 4C cut in their respective marginal edges in such a manner as to form the holes for receiving the terminals 5A, 5B when the semicylindrical members 4A and 4B are assembled together.

In this embodiment the both end faces 2A, 2B of insulating body 2 for engagement with plugs are stepped inside by a distance D from the opposite open end faces of the insulating cover 1, forming recesses 22*a* and 22*b* for receiving the plugs.

Figure 7:
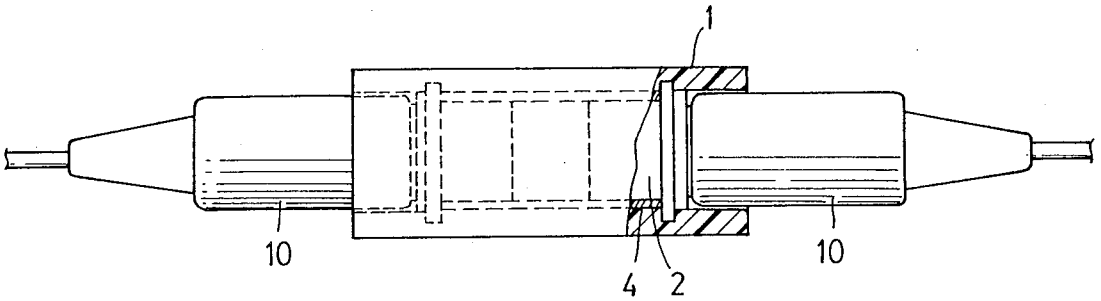
FIG. 7 is a side view, partly in section, schematically showing the connection of the shielding connector of the present invention to plugs.
Figure 8:
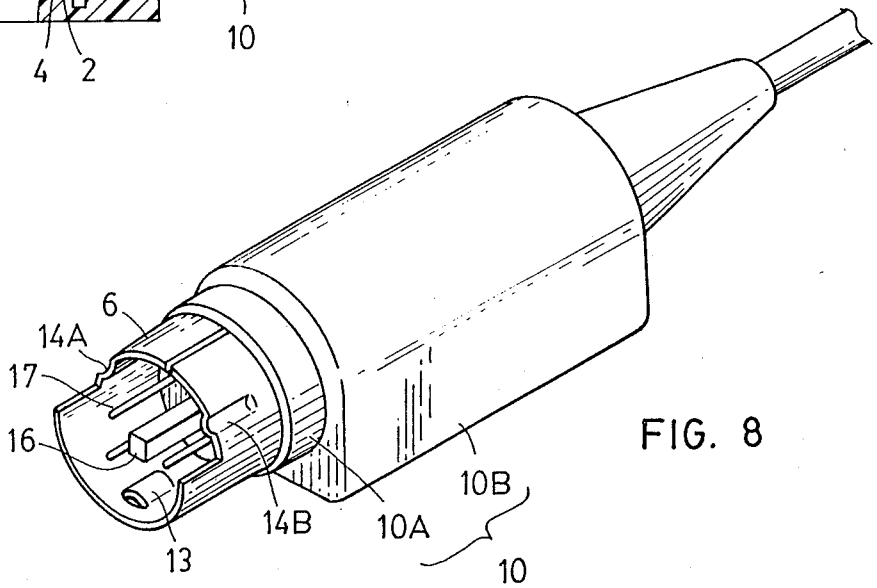
FIG. 8 is a perspective view illustrating an example of the structure of a plug which increases safety when inserted into the shielding connector of the present invention.

Since the plug engaging faces 2A, 2B of the insulating body 2 are thus stepped inside the insulating cover 1, end portions of the outer insulating covers 10 of the plugs are received in the recesses 22*a* and 22*b* defined by the insulating cover 1 of the shielding connector, as shown in FIG. 7, making it possible to prevent metal parts of the plugs from being exposed to the outside. Especially, in the case of using such a plug as shown in FIG. 8 in which the insulating cover 10 has small- and large-diametered portions 10A and 10B, the open end face of the insulating cover 1 is closed by the end face of the large-diametered portion 10B of the insulating cover 10 of the plug, further ensuring safety.

The shielding connector of this embodiment is assembled in the following order: First, the terminals 3*a* and 3*b* of the same pin numbers, which are led out of the inner end faces of the two insulating blocks 2*a* and 2*b* to which the annular contacts 5*a*, 5*b* and the female contacts 3 are mounted, are connected to each other and the terminals 5A, 5B of the annular contacts 5*a* and 5*b* are bent outwardly. Next, the semicylindrical members 4A and 4B, which form the cylindrical shielding conductor 4, are mounted around the insulating blocks 2*a* and 2*b* to extend between flanges 20A and 20B thereof formed adjacent the end faces 2A and 2B of the respective insulating blocks 2*a* and 2*b*. At this time, the terminals 5A, 5B are inserted into the notches 4C so that they project out onto the outer periphery of the cylindrical shielding conductor 4 through the holes formed by the notches 4C.

The terminals 5A, 5B thus projecting out onto the outer periphery of the cylindrical shielding contact 4 are soldered thereto, as indicated by 21, and also the cylindrical members 4A and 4B are joined together by soldering along their longitudinal marginal edges.

Then the connector assembly is inserted into a metallic mold for resin molding, wherein the tubular insulating cover 1 is molded around the cylindrical shielding conductor 4 as a unitary structure therewith.

The structure of the shielding connector of the present invention will be understood from the above. The outer surface of tubular insulating cover 1 may, if desired, be shaped to define a semicylindrical portion and a semirectangular portion which are joined to one another along an axis of the tubular insulating cover 1.

Figure 4:
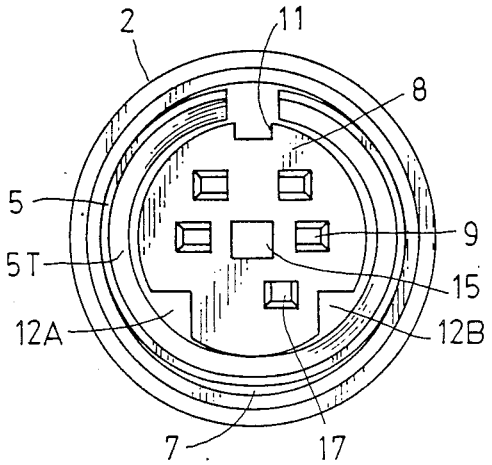
FIG. 4 is a front view showing the structure of a connector socket for use in the embodiment depicted in FIG. 1.
Figure 5:
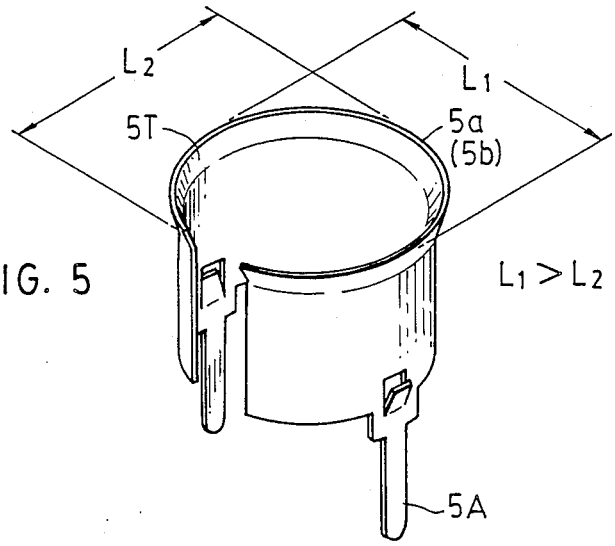
FIG. 5 is a perspective view showing an annular contact.

Next, a description will be given of the structure of the connector socket formed in the above-mentioned insulating block 2*a* but the description will not be repeated with respect to the connector socket of the insulating block 2*b*. The connector socket is substantially identical in construction, except its terminal portion, with the aforementioned United States patent application, as referred to previously. As depicted in FIG. 4, the connector socket has an annular groove 7 cut in one end face of the insulating block 2*a*, and the annular contact 5*a* shaped as shown in FIG. 5 is fitted in the annular groove 7.

Figure 6:
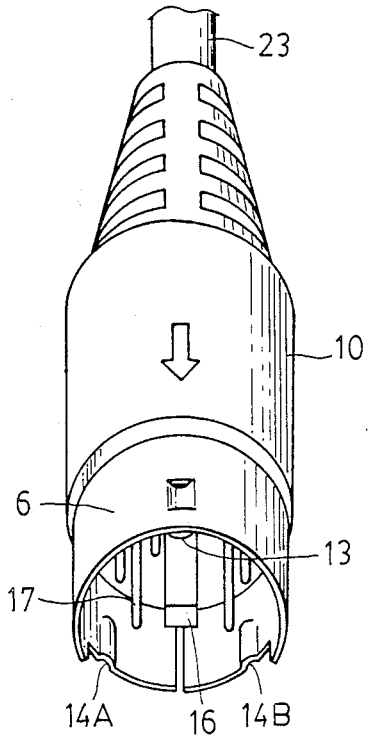
FIG. 6 is a perspective view showing an example of a plug which is inserted into the shielding connector of the present invention.

The central columnar portion 8 of the insulating block 2*a*, encompassed by the annular groove 7, has a plurality of female contact receiving holes 9 bored therethrough in parallel to the axis thereof. In this example, five female contact receiving holes 9 are made in the insulating block 2*a*. This structure has the following features:

First, the connector socket of the present invention is small but is designed for tight engagement with a plug. To this end, the annular contact 5*a* is slightly deformed from a true circle into an elliptic form with its two perpendicularly intersecting diameters $L_1$ and $L_2$ selected so that $L_1 > L_2$. Such an elliptically deformed annular contact 5*a* will clampingly engage the cylindrical metal cover 6 of the plug (FIG. 6). Accordingly, the connector socket is capable of firmly gripping the plug although the contact area therebetween is reduced as a result of miniaturization of the connector socket. As a result, the plug will not readily be disconnected from the socket even if cable 23 (FIG. 6) connected to the plug were pulled by accident.

Secondly, auxiliary grooves 12A and 12B as well as a main positioning groove 11 are cut in the insulating block 2*a* around the central columnar portion 8 in a manner to extend in parallel to the axis thereof, as shown in FIG. 4. The cylindrical metal cover 6 of the plug has an inwardly projecting main bump 13 and similar auxiliary bumps 14A and 14B which extend in parallel to the axis of the plug, as depicted in FIG. 6. The main positioning bump 13 and the auxiliary bumps 14A and 14B are made different in size for the purpose of ensuring correct engagement of the plug with the socket. With the provision of the three grooves 11, 12A and 12B and the three bumps 13, 14A and 14B, when the plug is inserted into the socket but not in a correct position, the three inwardly projecting bumps 13, 14A and 14B simply make slidable contact with the marginal edge of the central columnar portion 8 of the insulating block 2*a* surrounded by the annular groove 7 but the plug and the socket are axially aligned. This allows ease in turning the plug about the axis of the socket into engagement therewith. Thus the positioning means permits anyone to lock the plug to the socket.

Thirdly, a square hole 15 is made in the columnar portion 8 surrounded by the annular groove 7, as shown in FIG. 4. The hole 15 receives an insulating member 16 of a square cross-section which protrudes from the end face of the plug (FIG. 6). This also defines the correct position for engagement between the plug and the socket. The insulating member 16 is slightly longer than contact pins 17 of the plug. This allows insertion of the contact pins 17 of the plug into the female contact receiving holes 9 only when the insulating member 16 enters into the square hole 15 of the socket. In other words, the contact pins 17 of the plug would not be put into contact with female contacts 5*a* of the socket unless the plug is placed at a correct position for engagement with the socket. Accordingly, there is no fear of erroneous connections between the contact pins 17 of the plug and the female contacts 5*a* of the socket.

As described above, the connector socket is small but great in the force for engagement with a plug and facilitates positioning of the plug relative to the socket and eliminates the possibility of erroneous connections therebetween.

Accordingly, the application of this connector socket to the shielding connector of the present invention will produce the same effects as those obtainable with the connector socket.

With the use of such shielding connectors of the present invention described above, it is possible to connect a desired numbers of extension cables in series, each having been provided with plugs at both ends thereof. Therefore, no matter how far terminal units to be interconnected are from each other, it is necessary only to prepare extension cables and shielding connectors of the numbers corresponding to the distance between the terminal units and anyone can electrically connect them with ease.

Furthermore, since the shielding connector of the present invention has the cylindrical shielding conductor 4 mounted on the insulating body 2, the cable connecting portion is also shielded. This reduces the entry of external noise and prevents leakage of noise to the outside.

Moreover, according to the present invention, the open end face of the insulating cover 1 projects outwardly of the end face 2A of the insulating body 2 as described previously. With this structure, when the plug is inserted into the shielding connector, the end portion of the insulating cover 10 of the plug is received in the recess defined by the insulating cover 1 of the shielding connector, for example, as shown in FIG. 7, so that no metallic portions of the plug are exposed to the outside. This will prevent other conductors from electrically contacting the cable connecting portion and protect it from electric discharges emanating from other objects having a potential. Accordingly, the shielding connector of the present invention is safe and free from accidents of the type experienced in the prior art.

As described above, the shielding connector of the present invention can easily be assembled using two connector sockets.

While in the above description the shielding connector employs two connector sockets to form the insulating body 2, it is also possible to adopt an arrangement in which female contact receiving holes are made in both end faces of one insulating body so that female contacts are interconnected therein. The insulating cover 1 need not always be molded integrally with the shielding conductor 4 but may also be produced separately and mounted around it.

It will be apparent that many modifications and variations may be effected without departing from the scope of the novel concepts of the present invention.

What is claimed is:

1. A shielding connector comprising:

a tubular insulating cover having both of its ends open;

a cylindrical shielding conductor means held in close contact with the inner peripheral surface of the insulating cover and coaxially therewith;

a cylindrical insulating body means held in the shielding conductor means, both end faces of the insulating body means having first and second annular grooves cut therein about the axis of the insulating body means coaxially therewith, and first and second columnar portions on both end faces of the insulating body means, encompassed by the first and second annular grooves, respectively having made therein pluralities of first and second contact receiving holes;

first and second annular contacts respectively fitted in the first and second annular grooves and electrically connected to the cylindrical shielding conductor means, for engagement with cylindrical metal covers of mating plugs; and pluralities of first and second female contacts received in the first and second contact receiving holes in which corresponding ones of them are interconnected, for making contact with contact pins of the mating plugs.

2. A shielding connector according to claim 1 wherein the insulating body means is comprised of first and second insulating blocks respectively having received therein the first and second annular contacts, the first and second insulating blocks serving as first and second connector sockets, respectively, and the first and second connector sockets connecting the corresponding female contacts in the cylindrical shielding conductor means.

3. A shielding connector according to claim 2 wherein the insulating cover is molded integrally with an assembly of the cylindrical shielding conductor means and the first and second connector sockets disposed therein.

4. A shielding connector according to claim 2 wherein the outer end faces of the first and second connector sockets are respectively positioned inside both open end faces of the tubular insulating cover, forming recesses therein.

5. A shielding connector according to claim 4 wherein the cylindrical shielding conductor means is an assembly of first and second semicylindrical members, each having at least one notch cut in the marginal edge thereof so that the notches form a hole when the first and second semicylindrical members are assembled, terminals of the first and second annular contacts being led out of the cylindrical shielding conductor means through the hole and soldered to the outer periphery of the shielding conductor means.

6. A shielding connector according to claim 5 wherein the end faces of the first and second columnar portions each have made therein a square hole for receiving a square-sectioned insulating member of the plug.

7. A shielding connector according to claim 5 wherein the end faces of the first and second insulating blocks each have cut therein a main positioning groove and a plurality of auxiliary positioning grooves around the columnar portion for engagement with a main positioning bump and auxiliary positioning bumps provided on the inside of a cylindrical metal cover of the mating plug.

8. A shielding connector according to claim 3 wherein the outer end faces of the first and second connector sockets are respectively positioned inside both open end faces of the tubular insulating cover, forming recesses therein.

9. A shielding connector according to claim 8 wherein the cylindrical shielding conductor means is an assembly of first and second semicylindrical members, each having notches cut in the marginal edges thereof so that they form holes when the first and second semicylindrical members are assembled, terminals of the first and second annular contacts being led out of the cylindrical shielding conductor means through the holes and soldered to the outer periphery of the shielding conductor means.

10. A shielding connector according to claim 9 wherein the end faces of the first and second columnar portions each have made therein a square hole for receiving a square-sectioned insulating member of the plug.

11. A shielding connector according to claim 9 wherein the end faces of the first and second insulating blocks each have cut therein a main positioning groove and a plurality of auxiliary positioning grooves around the columnar portion in parallel to the axis of the insulating block, for engagement with a main positioning bump and auxiliary positioning bumps provided on the inside of a cylindrical metal cover of the plug.

12. A shielding connector according to claim 1, wherein the tubular insulating cover has a portion defining a semicylindrical outer surface and a portion defining a semirectangular outer surface joined to each other along an axis of the tubular insulating cover.

13. A shielding connector according to claim 1, wherein the cylindrical insulating body means has flanges adjacent both end faces thereof and extends between the flanges.

14. A shielding connector according to claim 2, wherein the first and second connector sockets are identical in structure to each other and corresponding ones of the first and second female contacts are electrically connected to each other.

* * * * *